US006171269B1

(12) United States Patent
Norin

(10) Patent No.: US 6,171,269 B1
(45) Date of Patent: Jan. 9, 2001

(54) MULTI-FUNCTION PODIATRIC DEVICE

(76) Inventor: Mona Norin, Backägen 7, S-171 35 Solna (SE)

( * ) Notice: Under 35 U.S.C. 154(b), the term of this patent shall be extended for 0 days.

(21) Appl. No.: 08/714,118

(22) PCT Filed: Mar. 7, 1995

(86) PCT No.: PCT/SE95/00242

§ 371 Date: Sep. 9, 1996

§ 102(e) Date: Sep. 9, 1996

(87) PCT Pub. No.: WO95/24175

PCT Pub. Date: Sep. 14, 1995

(30) Foreign Application Priority Data

Mar. 8, 1994 (SE) ..... 9400786

(51) Int. Cl.[7] ..... A61H 7/00

(52) U.S. Cl. ..... 601/134; 601/28; 601/136; 601/75.6

(58) Field of Search ..... 132/286, 76.4, 132/75.6; 601/28, 134, 136, 22, 138, 135, 137, 27

(56) References Cited

U.S. PATENT DOCUMENTS

| | | | | |
|---|---|---|---|---|
| 2,735,434 | * | 2/1956 | Rossett | 132/76.4 |
| 3,434,716 | * | 3/1969 | Brantingham et al. | 601/136 |
| 3,543,747 | * | 12/1970 | Gustafson | 601/136 |
| 3,939,825 | | 2/1976 | Krummenacher . | |
| 4,617,917 | * | 10/1986 | Miller | 601/136 |
| 5,293,660 | * | 3/1994 | Park | 15/160 |
| 5,343,882 | * | 9/1994 | Iannone | 132/286 |

FOREIGN PATENT DOCUMENTS

| | | | |
|---|---|---|---|
| 32 13417 | | 3/1983 | (DE) . |
| 32 47435 | | 6/1984 | (DE) . |
| 003839251 | * | 5/1990 | (DE) ..... 601/134 |

* cited by examiner

*Primary Examiner*—Jerome Donnelly
(74) *Attorney, Agent, or Firm*—Fasth Law Offices; Rolf Fasth

(57) ABSTRACT

A podiatric device (2) for use in bathtubs or shower cabinets for instance, wherein the device includes a mat (3) which is provided with resilient, elongated bosses (10) on two-thirds of its upper surface, said bosses acting on the sole of a foot resting on the mat. The entire undersurface of the mat is provided with suction cups (18) which function to secure the mat firmly to a smooth undersurface. The mat also includes a foot-filing part (5) which includes a convex, dome-shaped filing element (6). The outer surface of the filing element has affixed thereto an abrasive agent such as abrasive paper or abrasive granules. The device also includes an arrangement of brushes by means of which the upper and bottom surfaces of a foot can be cleaned simultaneously, including between the toes, while leaving the hands free to soap the body or shampoo the hair.

10 Claims, 1 Drawing Sheet

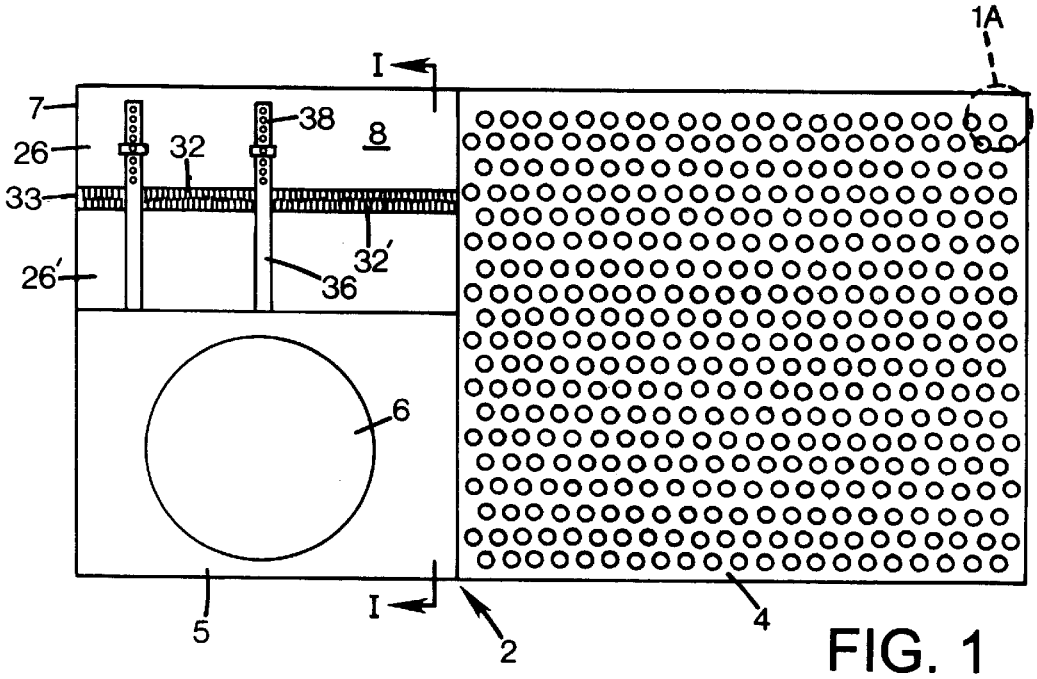
FIG. 1
FIG. 1A
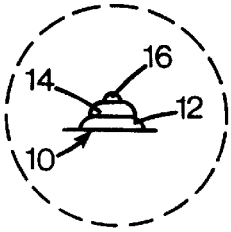
FIG. 2
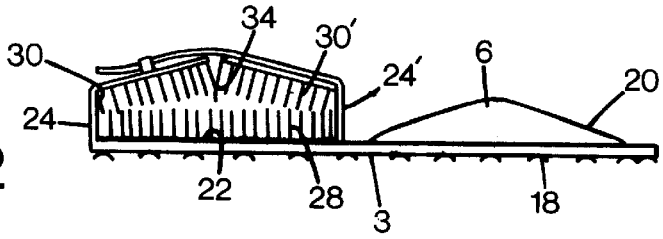

MULTI-FUNCTION PODIATRIC DEVICE

The present invention relates to a podiatric device for use in bathtubs, shower facilities or on a floor surface for instance. The device includes a mat having on its upper surface resilient bosses or like protuberances which have a massaging effect on the sole of a foot resting on the mat.

Podiatric devices which include massaging protuberances are previously known from CH 664 893-A5 or DE 38 39 251-A1, for instance. The first-mentioned publication relates to a so-called "acupressure mat" which includes regularly spaced elongated bosses or like protuberances provided with rounded tops. The bosses are disposed in rows which extend parallel with the mat edges and have varying lengths or heights. The height variations follow a particular pattern such that parts adapted to the sole of a right and a left foot include toe and heel regions having shorter bosses and regions of longer bosses for massaging the arch of the foot. The lengths of the bosses may also be adapted to stimulate certain reflexion centres beneath the soles of the feet.

DE 38 39 251 teaches a massaging mat with an improved design of the massaging bosses or like protuberances, these bosses being adjustable elastically in the longitudinal direction and therewith resilient and self-equalizing, despite being relatively stiff. This effect is achieved by narrowing the cross-section adjacent the base part of each boss, said base part having the form of a suction cup.

DE 26 06 811-A1 teaches devices for brushing and cleaning parts of the body. These devices can be mounted in bathtubs or in shower cabinets or like showering facilities and are used to clean or brush parts of the body that are difficult to reach, for instance the back, without using the hands.

The aforedescribed known devices are very suitable for their respective purposes. However, in order to use the time spent in the bath or the shower cabinet effectively, there is a need for a podiatric device which will enable the sole of one foot to be massaged while filing away dead skin from the heel of the other foot, or which will enable the upperside and the underside of the other foot to be cleaned simultaneously while leaving the hands free for soaping remaining parts of the body or for shampooing the hair. The device shall also be easily handled, easy to stow away when not in use and relatively inexpensive to manufacture.

Accordingly, the object of the invention is to provide a multi-function podiatric device which includes means for massaging the soles of the feet and for performing at least one of the skinfiling and footcleaning functions.

This object is achieved with a podiatric device comprising a part which includes at least one foot filing element for removing hard skin. According to one preferred embodiment of the invention, the mat also has a part which includes a foot-brushing arrangement. Advantageous further embodiments and improvements are set forth in the dependent claims.

The invention will now be described in more detail with reference to exemplifying embodiments thereof and also with reference to the accompanying drawing, in which FIG. 1 illustrates an inventive podiatric device schematically from above; and FIG. 2 is a sectional view of the podiatric device shown in FIG. 1 taken on the line I—I.

In the case of one preferred embodiment the inventive podiatric device 2 is comprised of a flexible base plate or mat 3 made of plastic or rubber material. The mat has a rectangular shape and has the form of a conventional massage mat 4 over about two-thirds of its length. The remaining third of the mat includes a foot-filing part 5 provided with a filing element 6, and a foot-brushing part 7 provided with a brush arrangement 8. The mat 3 is suitably about 75 cm long and 40 cm wide and has a thickness of 2–5 mm. Elongated massaging bosses or like protuberances 10 are disposed in straight rows in the longitudinal direction of the mat 4, the bosses and the rows being mutually equidistant. Each alternate row of bosses has a length which differs from the lengths of immediately adjacent rows and the bosses 10 in each row are laterally displaced by half a pitch in relation to an immediately adjacent row or rows. Each boss 10 has a disc-shaped base part 12 which has a diameter of about 10 mm and a thickness of about 3 mm. The base part rests on a similarly configured intermediate part 14 which is centred coaxially with the base part. The diameter of the intermediate part is slightly smaller than the diameter of the base part, whereas the thickness of the intermediate part is roughly the same as the thickness of the base part. Each boss is terminated with a top part 16 which is also centred coaxially with the two remaining parts of the boss, the diameter of the top part being smaller than the diameters of the remaining parts.

The mat 3 also includes a plurality of conventional suction cups 18 disposed uniformly over the whole of the underside of the mat, with a pitch or spacing of about 3 cm such as to provide a firm fixture to a smooth undersurface.

The filing element conveniently has the form of plastic dome-shaped element 6 whose outer surface carries an abrasive agent 20 and is fastened with the base part against the filing section 5 of the mat 3. The dome-shaped element 6 will suitably have a base diameter of 18 cm and a height of 35 mm. The element 6 is secured to the mat in a conventional manner, for instance by so-called Velcro® fasteners or snap-on fasteners (not shown) which coact with corresponding fastener flanges (not shown) incorporated in the mat. Although not shown, the plastic filing element 6 may be secured to the mat with the aid of through-penetrating screw fasteners, as an alternative to the aforesaid fastening devices. The abrasive agent will preferably have the form of abrasive granules glued to the outer surface of the plastic element 6. This is achieved by first dipping the outer convex surface of the dome-like element into an adhesive and then into a powder comprised of said abrasive granules. Wet abrasive paper of a conventional kind can also be used, in which case the abrasive paper is shaped to fit the curved upper surface of the element 6 and will include a self-adhesive backing, or some other appropriate fastener means.

The brush unit 8 of the illustrated embodiment is manufactured from an appropriate resilient plastic material and includes a fixed brush 22 and two brushes 26, 26' which are pivotally connected to the fixed brush by means of a respective hinge means 24, 24'. The fixed brush 22 is detachably secured to the part 7 with the spine of the brush facing the mat 3, and includes bristles 28 which are essentially upstanding from the mat surface. The brush unit 8 is preferably secured to the mat in the same way as that described above with reference to the filing element 6. Each hinge 24, 24' is connected to a respective edge on the spine of the fixed brush 22 and projects up essentially at right angles to the mat 3. Each pivotal brush 26, 26' is connected, in turn, to a respective horizontal edge surface of respective hinges 24, 24' and can be swung between a first and a second end position by virtue of the resiliency of the material used. When located in their first end positions, in which no load is applied to the brushes, the bristles 30 of the brushes 26, 26' will define a generally obtuse angle (10–15°) with the mat 3. Each pivotal brush has a free edge 32, 32' facing towards respective brushes and between which a gap 33 is formed in this position of the brushes. A space 34 into which a foot to be scrubbed can be inserted is also formed at the same time between the working surfaces of the brushes. The size of the space 34 can be varied, by adjusting the angular positions of the brushes 26, 26'. The podiatric device also includes two mutually parallel tensioning straps 36 which are mounted on the upper side of the pivotal brushes 26, 26' and have strap tensioning holes 38 and a conventional buckle (not shown), wherein the straps enable the brushes 26, 26' to be urged downwards to the aforesaid second end position,he spring force exerted by the material, in which the edges 32, 32' of respective brushes abut one another and the gap 33 is closed. The space 34 will also be closed, since the top extremities of the bristles of the fixed and the movable brushes will abut one another (not shown) when the pivotal brushes are in said second end position. The brush unit 8 can thus be adapted to feet of different sizes or to achieve different purposes, e.g. to provide a hard or a soft brushing action, by varying the tension in the tensioning straps. The brush unit will conveniently have a length of 30 cm, a width of 18 cm, and the height of the long sides will suitably be 4 cm and the central height 6 cm, as measured from the free edges 32, 32' of the pivotal brushes when the brushes are in their first end position.

The podiatric device is used in the following way. The mat is placed on the floor of a shower cabinet or on the bottom of a bathtub equipped with a shower and used while taking a shower. By tramping on the bossed part of the mat, the feet of the user are given a soft massage which imparts a feeling of well-being throughout the body and increases the circulation of blood in the feet. The convex domed shape of the filing element enables the feet to be filed easily and effectively, since only a minimum amount of force is required to file away dead skin. The user will simply place one foot on the raised filing element and then slide the foot down the right side and then the left side of said element, or will simply move the foot up and down to obtain the desired filing effect. The user may then choose to insert the foot into the brush unit and then move the foot backwards and forwards. This enables the foot to be brushed clean on both the upper and undersurfaces thereof and even between the toes, in one single instance, and the brush unit can also be adjusted to accommodate feet of different shapes and sizes or to satisfy different brushing requirements.

It will be understood that the present invention is not restricted to the aforedescribed and illustrated exemplifying embodiments thereof and that the invention includes all embodiments and equivalent solutions that lie within the scope of the following claims. For instance, each massaging boss may be a one-piece structure, and the bosses may also be formed integrally with the mat. It may also be beneficial to provide the foot-filing part of the device with two or more filing elements, so as to enable both sides of the heel of a foot to be filed at the same time, for instance. The massaging bosses may also be disposed in a special pattern and have varying lengths, for instance the bosses starting from the centre of the mat may be longer than remaining bosses and decrease in lengths of increasing diameter in a circular pattern, to suit feet that have high arches. The mat may also be round or oval in shape, instead of rectangular. The brush unit may also have a similar alternative outer shape, and will then suitably be comprised of two crescent-shaped parts, such that the brush unit will also have a rounded oval shape when seen from above.

What is claimed is:

1. A podiatric device for use in bathtubs, shower cabinets or on a floor surface for instance, said device comprising a mat which includes on the upper side thereof elongated, resilient massage bosses for massaging the sole of a foot resting on the mat, characterized in that the elongated bosses are disposed over essentially two-thirds of the upper side of the mat; and in that the mat includes a part having at least one replaceable foot filing element for the removal of hard skin and a foot-cleaning brush unit attached to the mat, the replaceable foot filing element and the foot-cleaning brush unit being separate from the resilient massage bosses.

2. A device according to claim 1, wherein the foot-cleaning brush unit has at least one replaceable and adjustable brush, wherein the brush unit can be adjusted to feet of different sizes and to different hard brushing or soft brushing requirements.

3. A device according to any one of claims 1–2, characterized in that the brush unit includes a fixed brush and at least two brushes that can be moved between a first and a second end position relative to the fixed brush.

4. A device according to claim 3, characterized in that the fixed brush has bristles which extend generally at right angles from the mat; in that the bristles of the movable brushes define essentially an obtuse angle with the mat; and in that there is formed between the working surfaces of the brushes a space for insertion of a foot to be scrubbed, said space being variable in accordance with the positional settings of the movable brushes.

5. A device according to claim 3 or claim 4, characterized in that the device includes a tensioning device for adjusting the first end position of the movable brushes; and in that the second end position of said movable brushes is determined by the plane in which the top extremities of the bristles on the fixed and the movable brushes abut one another.

6. A device according to claim 5, characterized in that the tensioning device includes at least one tensioning strap having fixed tension adjustment holes.

7. A device according to any one of claims 1–6, characterized in that the at least one foot filing element is replaceable and has the form of a blunt cone.

8. A device according to any one of claims 1–6, characterized in that the foot filing element is an exchangeable, dome-shaped plastic body having affixed to its outer surface an abrading agent in the form of an abrasive paper or abrasive granules.

9. A device according to any one of claims 1–8, characterized in that the massaging bosses are disposed uniformly in rows in uniform spaced relationship between said bosses and said rows; in that mutually adjacent rows have different lengths; and in that the bosses of one row are displaced laterally through half a pitch in relation to at least one adjacent row.

10. A device according to any one of the preceding claims, characterized in that the mat is provided with suction cups distributed over the whole of the underside of the mat and that the massage bosses are elongated and disposed over essentially two-thirds of the upper side of the mat.

* * * * *